United States Patent [19]

Berlemont

[11] 3,930,647

[45] Jan. 6, 1976

[54] SKATING RINK ASSEMBLED FROM A KIT

[75] Inventor: Ray Berlemont, Alvinston, Canada

[73] Assignee: The Raymond Lee Organization, Inc., New York, N.Y. ; a part interest

[22] Filed: Oct. 3, 1974

[21] Appl. No.: 511,669

[52] U.S. Cl. ..... 272/3; 4/177; 62/235; 150/.5; 220/5 A

[51] Int. Cl.[2] ..... A63C 19/10

[58] Field of Search.. 272/3; 62/235; 4/172, 172.19, 4/177; 150/.5; 220/1 B, 5 A, 18, 63 R, 80; 256/19, 21

[56] References Cited

UNITED STATES PATENTS

| | | | |
|---|---|---|---|
| 2,616,096 | 11/1952 | Hasselquist | 4/177 |
| 2,730,150 | 1/1956 | Wunderwald et al. | 150/.5 X |
| 2,797,896 | 7/1957 | Cook et al. | 256/19 X |
| 2,907,362 | 10/1959 | Owen | 150/.5 |
| 2,989,757 | 6/1961 | Friedlander et al. | 4/172.19 |
| 2,996,896 | 8/1961 | Johnson | 62/235 |
| 3,012,596 | 12/1961 | Skolout | 150/.5 |
| 3,233,251 | 2/1966 | Barrera | 4/172 |
| 3,797,049 | 3/1974 | De Santo | 4/172.19 |
| 3,808,831 | 5/1974 | Landry | 62/235 |

FOREIGN PATENTS OR APPLICATIONS

| | | | |
|---|---|---|---|
| 958,744 | 5/1964 | United Kingdom | 150/.5 |

*Primary Examiner*—Richard C. Pinkham
*Assistant Examiner*—R. T. Stouffer

[57] ABSTRACT

A plastic annular floor is attached to the ground by tacks. The outer periphery of the floor is bent vertically upwards to form a wall. A circular vertical band abuts the outside of the wall. The floor is held against the band by clips which are driven into the ground. Thus, a squat vertical cylinder with a wide diameter is formed, with an open top. In winter, the cylinder can be filled with water which after freezing can be used to provide a surface for skaters. In summer, the cylinder without water can be used to provide a surface for roller skates.

4 Claims, 7 Drawing Figures

SKATING RINK ASSEMBLED FROM A KIT

SUMMARY OF THE INVENTION

The invention is directed towards a kit which may be used to assemble an outdoor skating rink.

Thus, an annular flexible plastic floor is attached to the ground by tacks. The outer periphery of the floor is bent vertically upwards to form a wall. A vertical circular band abuts the outside of the wall. Clips hold the floor to the inside of the band, and also secure the band to the ground, to form a squat, wide vertical cylinder with an open top.

When the inside of the rink is filled with water in cold weather, a circular disc of ice will be formed, which can be skated upon.

When the inside of the rink is not filled with water, as for example in summer use, users wearing roller skates can skate therein.

DETAILED DESCRIPTION OF PREFERRED EMBODIMENTS

Figure 1:
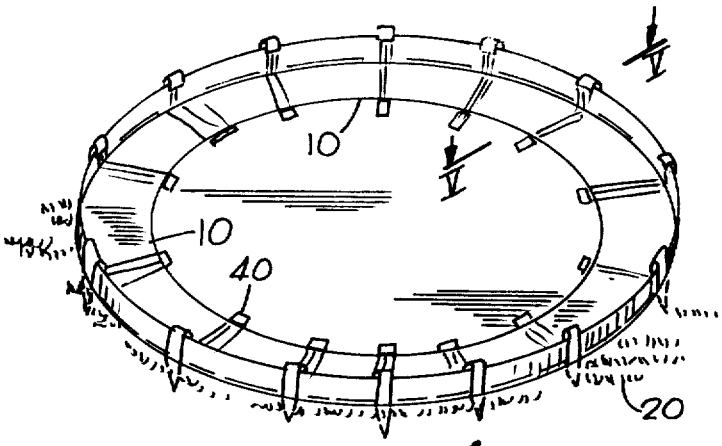
FIG. 1 is a top view of the invention.
Figure 2:
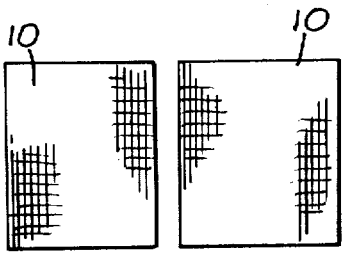
FIG. 2 is a top view of two plastic pieces.
Figure 3:
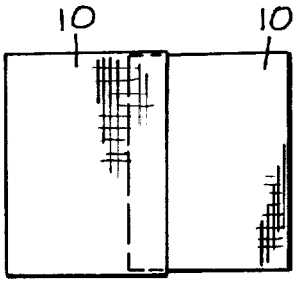
FIG. 3 shows the plastic pieces overlapping.
Figure 4:
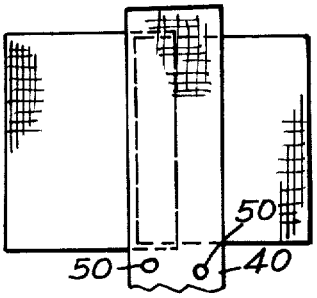
FIG. 4 shows a plastic strap overlying the overlap of the plastic pieces, which strap has tacks therethrough for ground attachement thereof.
Figure 5:
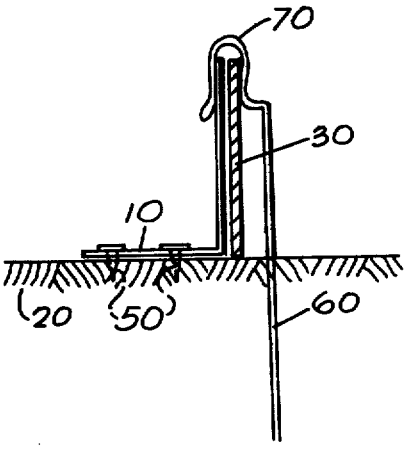
FIG. 5 is a view along line 5—5 in FIG. 1.
Figure 6:
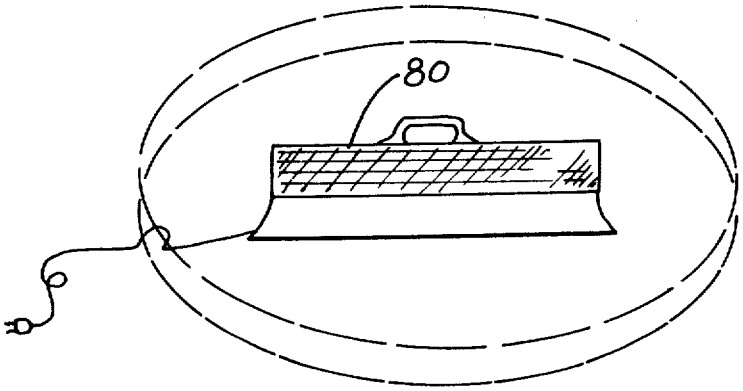
FIG. 6 shows a blower in use with the invention.
Figure 7:
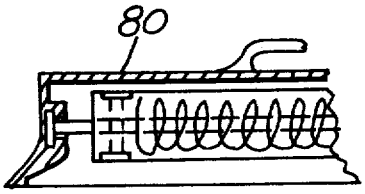
FIG. 7 shows a cross-section of the blower.

Referring now to the drawings, a plurality of flexible rectangular plastic sheets 10 are placed on the ground 20 and overlap each other as shown in FIG. 3, and are shaped into an annulus, which overlaps the inside of a circular corrugated metal band 30. Rectangular plastic straps 40 are placed on top of the boundaries between adjacent sheets and are attached to the ground by tacks 50. Clips 60 have their lower extremities driven into the ground and extend upwardly against the outside of the band, to a U shaped band 70 which holds the sheets up against the band. Thus, a squat, wide, vertical and hollow cylinder is formed, with an open top. If the ground which is exposed is sufficiently impermeable to water, the cylinder can be filled with water in cold weather, the water will freeze and a disc of ice may be formed upon which the user may skate. If the ground is soft or otherwise cannot be used as indicated a plastic sheet can be disposed under the annulus to seal off the opening. The cylinder can then be filled with water as before. A blower 80 can be used to blow air over the water in the cylinder to facilitate freezing and ice formation, providing that the ambient temperature is sufficiently below the freezing temperature of the water.

If desired, during warmer weather, no water should be added and the arrangement can be used to provide a suitable surface for roller skating.

While the invention has been described with detailed reference to the drawings, the protection sought is to be limited only by the terms of the claims which follow.

I claim:

1. A skating rink assembled from a kit and comprising:

an annular floor disposable on the ground and having its outer edge bent vertically upward to form a circular wall, said floor including a plurality of like flexible plastic sheets taking on the shapes of rectangles disposed side by side to form an annulus and a like plurality of elongated rectangular plastic straps, each strap overlying the boundary between two adjoining ones of said sheets;

a circumferential vertical ring surrounding the floor and abutting the outside of said circular wall; and fasteners for securing the ring and wall to the ground.

2. The rink of claim 1 wherein said ring is a corrugated metal band.

3. The rink of claim 2 further including tacks extending through said straps adapted to extend into the ground.

4. The rink of claim 3 wherein said fasteners are elongated clips which have sharp tips at their lower extremities and have U-shaped bends at their upper extremities, said sharp tips adapted to extend into the ground, said bends extending over the top of the band and the top of the circular wall and squeezing the floor and band together.

* * * * *